US005306057A

United States Patent [19]

Miller, Jr.

[11] Patent Number: 5,306,057

[45] Date of Patent: Apr. 26, 1994

[54] LATCHING COVER FOR BULK STORAGE STRUCTURES

[75] Inventor: George E. Miller, Jr., Raytown, Mo.

[73] Assignee: Butler Manufacturing, Kansas City, Mo.

[21] Appl. No.: 106,646

[22] Filed: Aug. 16, 1993

[51] Int. Cl.[5] ..... E05C 9/18

[52] U.S. Cl. ..... 292/259; 49/465; 292/189

[58] Field of Search ..... 292/145, 156, 162, 183, 292/189, 259, 302, DIG. 65; 49/464, 465

[56] References Cited

U.S. PATENT DOCUMENTS

| | | | |
|---|---|---|---|
| 590,332 | 9/1897 | Palmetier . | |
| 1,208,332 | 12/1916 | Knepley | 49/465 |
| 1,330,847 | 2/1920 | Crocker . | |
| 1,359,702 | 11/1920 | Hockenberry . | |
| 1,405,013 | 1/1922 | Schnell . | |
| 1,935,941 | 11/1933 | Chandonia | 292/145 X |
| 2,194,230 | 3/1940 | Lewis . | |
| 2,341,763 | 2/1944 | Craine . | |
| 2,550,856 | 5/1951 | Ouellet et al. | 292/6 |
| 2,767,008 | 10/1956 | Oswald | 292/241 |
| 3,039,837 | 6/1962 | Poe | 312/320 |
| 3,081,118 | 3/1963 | Krause | 292/226 |
| 3,416,829 | 12/1968 | Russell et al. | 292/341.19 |
| 3,435,578 | 4/1969 | Taylor et al. | 52/396 |
| 3,605,342 | 9/1971 | Koser | 49/465 |
| 4,330,147 | 5/1982 | Nolen | 292/259 R |
| 4,595,220 | 6/1986 | Hanchett, Jr. et al. | 292/341.16 X |
| 4,913,478 | 4/1990 | Grossman | 292/259 R |
| 5,135,271 | 8/1992 | Bestwick | 292/218 |

*Primary Examiner*—Richard E. Moore

*Attorney, Agent, or Firm*—Kokjer, Kircher, Bowman & Johnson

[57] ABSTRACT

A latch arrangement for an access opening cover on a bulk material storage structure. The access opening will include a frame defining an opening periphery, with the covers hinged for movement between a closed position and an open position. Each cover will include at least one slide bar extending between sides of the cover. Each slide bar has a length such that the ends of the slide bar are in proximity to the frame. Lock studs extend inwardly from the frame, with one stud associated with each end of each slide bar. Each slide bar is mounted for sliding movement perpendicular to its longitudinal axis in the plane of the cover between latched and unlatched positions, and includes a stud face and a lock face. The stud face includes slits through which the studs may pass at the closed position of the cover, allowing the bar to drop down over the stud. When dropped down over the stud into the latched position, the lock face abuts against the stud, arresting movement of the bar.

9 Claims, 1 Drawing Sheet

LATCHING COVER FOR BULK STORAGE STRUCTURES

BACKGROUND OF THE INVENTION

1. Field of the Invention

The present invention relates in general to latching covers or doors for access openings in bulk storage structures such as grain bins. In particular, the present invention relates to a latching cover of this type having increased ease of use.

2. Description of the Related Art

Bulk storage structures such as grain bins are typically large structures formed of overlapping panels of sheet material to form cylinders which are stacked one upon the other, as described and shown in U.S. Pat. No. 4,913,478 to Grossman. When the material stored within the structure is confined by the structure itself, such as with grain or other granular material, the cylindrical wall supports the material, causing large forces to be transferred through the walls in the form of hoop stresses.

As is recognized in the art, the formation of access openings in the sides of such structures reduces their structural integrity, and efforts have been made to allow covers for such openings to pass the hoop stresses therethrough. One method shown in the above-noted U.S. patent to Grossman and in U.S. Pat. No. 5,135,271 to Bestwick is to form a door frame having a rectangular periphery connected to the wall of the structure. Several covers are pivoted to one edge of the frame to allow the covers to move from open to closed positions. Each of the covers include a pivoted bar extending across the associated cover, with pivoting being between latched and unlatched positions. Each bar includes at it ends recesses which receive studs extending from the door frame, when the bars are in the latched position.

By this arrangement the bars may be lodged against the studs on the frame, allowing transmission of the hoop stress through the cover and/or latching mechanism. While these arrangements are adequate for transmission of the stresses, they are often difficult to use. For example, the forces exerted by the stored material often cause the bars to become lodged in the latched position, such that it is very difficult to move the bar to the unlatched position. Additionally, the latch arrangements require manual pressure to move to the latched position with the bars engaged. This pressure can sometime be high, increasing the possibility that latching will not be accomplished and the stress transfer arrangement not achieved.

SUMMARY OF THE INVENTION

An object of the present invention is to provide a door or cover for a bulk storage structure which allows at least hoop stresses to be passed therethrough.

Another object of the present invention is to provide a latch arrangement which may be easily released from the latched position.

A further object of the present invention is to provide such a latch arrangement which may be easily placed in the latched position with minimal effort.

Another object of the present invention is to provide a latch arrangement which will prevent inadvertent latching of the cover with a user inside the structure.

These and other objects are achieved by a latch arrangement for an access opening cover on a bulk material storage structure. The access opening will include a frame defining an opening periphery, with the cover hinged for movement between a closed position and an open position. One or more covers may be employed with a single opening. Each cover will include at least one slide bar extending between sides of the cover. Each slide bar has a length such that in the closed position of the cover the ends of the slide bar are in proximity to the frame. Lock studs extend inwardly from the frame, with one stud associated with each end of each slide bar. Each slide bar is mounted for sliding movement perpendicular to its longitudinal axis in the plane of the cover between latched and unlatched positions, and includes a stud face and a lock face. The stud face includes slits through which the studs may pass at the closed position of the cover, allowing the bar to drop down over the stud. When dropped down over the stud into the latched position, the lock face abuts against the stud, arresting movement of the bar.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1A:
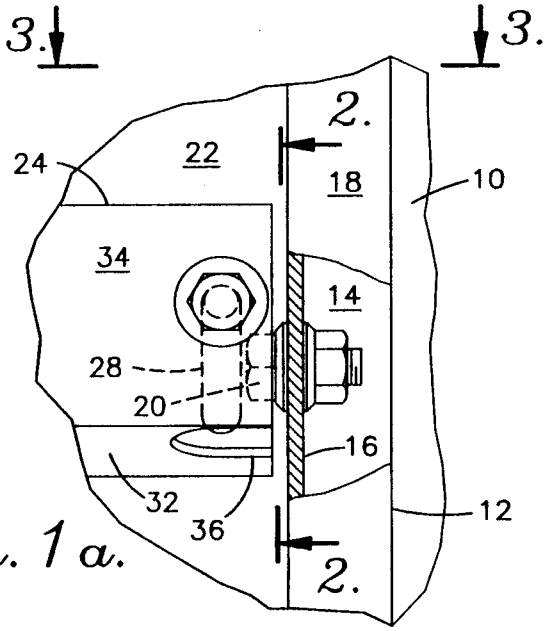
FIG. 1*a* is a detail front view in partial cross-section.
Figure 1:
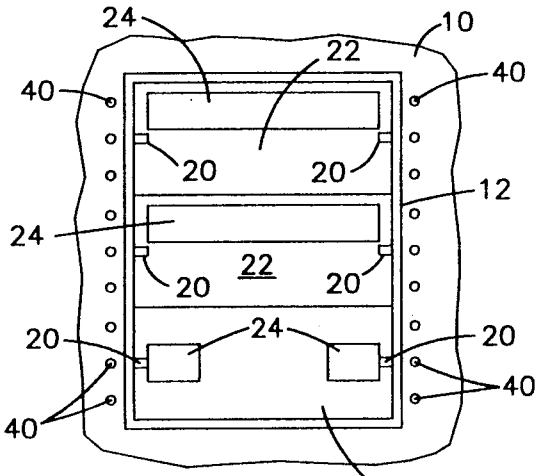
FIG. 1 is a front view of a frame and cover arrangement according to the present invention.

With reference to FIG. 1, reference numeral 10 designates a wall of a bulk storage structure such as a grain bin. As is known in the art, and as shown in the above-noted patents to Grossman and Bestwick, such structures are typically formed of corrugated sheet metal segments connected together to form walls, which are typically cylindrical. Set within the wall 10 of the structure is a door frame 12. The door frame has a periphery, usually rectangular, which defines an access opening through the wall of the structure to allow access to the interior of the structure.

Figure 3:
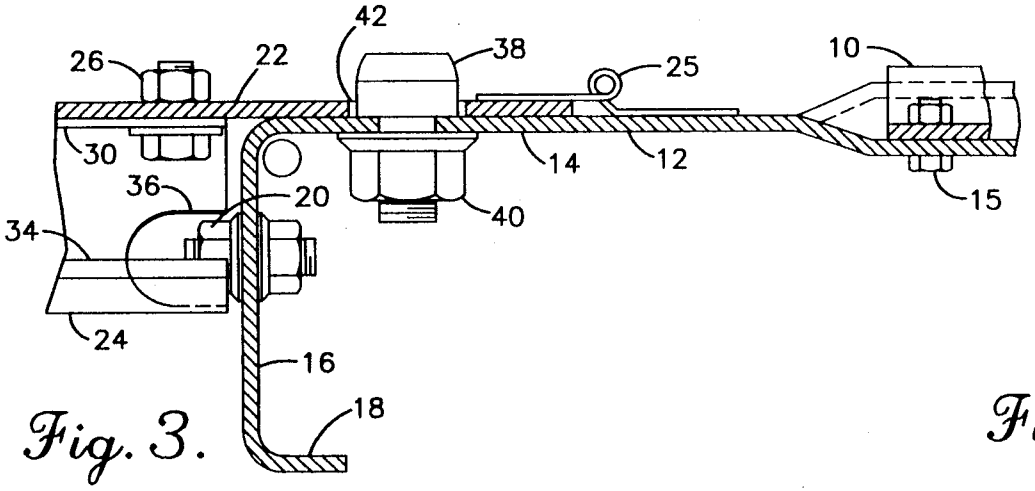
FIG. 3 is a top view.

As is best shown in FIG. 3, the door frame 12 of the preferred embodiment includes a connector section 14 generally within the plane of the wall 10, and is rigidly secured to the wall 10 by appropriate fasteners 15. The peripherally inner edge of the connector section 14 mounts an outwardly extending (with respect to the structure) stud section 16. The outer edge of the stud section may include a peripherally outward extending flange section 18 to provide added strength about the access opening. As is shown in the drawings, it is preferred that these sections be formed of a monolithic piece of material (preferably metal such as steel), at least for each edge of the frame.

The door frame mounts at least one stud 20, having the general form of a cantilevered protrusion extending peripherally inward of the frame 12. The longitudinal axis of the stud preferably extends substantially horizontal, such that the stud(s) are typically mounted on vertically extending portions of the frame 12, as shown in FIG. 1. The studs may be formed in a variety of ways, but are preferably formed by a bolt or threaded bar extending through the stud section 16 and having nuts mounted thereon, with one of the nuts defining the stud.

The frame 12 also mounts at least one cover 22 serving to selectively close the access opening defined by the frame. The cover(s) 22 are pivotally mounted to the frame, as by hinges 25, and typically pivot about a substantially vertical axis. Where multiple covers are employed, they are typically vertically aligned and pivot about a substantially common axis, which, again, is typically substantially vertical. The covers are formed of rigid material such as metal or wood.

Mounted upon each of the covers is a slide bar 24. The slide bar is elongated, defining a longitudinal axis, and may have a length slightly less than the distance between the peripherally interior edges of the frame at the particular location of the slide bar in question. As such, the slide bar typically extends substantially across the associated cover 22, as with the upper two covers 22 in FIG. 1. Alternatively, one or two shorter length slide bars may be employed on a cover, as shown in the lowest cover 22 in FIG. 1. With this arrangement the slide bars have one end in proximity to a peripherally interior edge of the frame, for reasons made clear below.

Each of the slide bars is associated with at least one, and preferably two of the studs 20. In particular, for each slide bar 24 it is preferred that there be at least one (and in the case of the long slide bar, preferably two) stud 20 extending from the frame 12. Where two studs are employed for a single slide bar the studs are preferably opposed and substantially coaxial, with the longitudinal axis of the associated slide bar 24 being substantially parallel to the longitudinal axes of the studs.

Each slide bar is mounted to the associated cover for sliding movement in a plane containing the cover, or in other words upon the outer face of the cover. This sliding may be effected by providing two or more slide bolts 26, each extending through an associated throughhole in the cover and through an associated slot 28 in the slide bar. The slide bolts 26 include enlarged heads having a width greater than that of the associated slot, and the bolts ar tightened to a position which allows free sliding movement of the slide bar with respect to the associated cover. As will be apparent from the discussion below, this sliding movement is oriented and of such an extent that a portion of the slide bar passes through the longitudinal axes of the associated studs as the slide bar travels between the extremes of the sliding movement.

Figure 2:
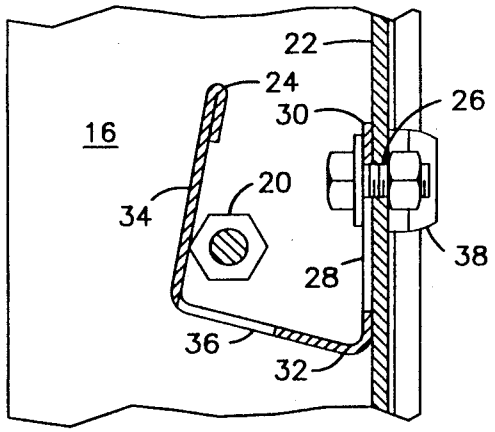
FIG. 2 is a cross-sectional side view along line 2—2 of FIG. 1*a;*
Figure 4:
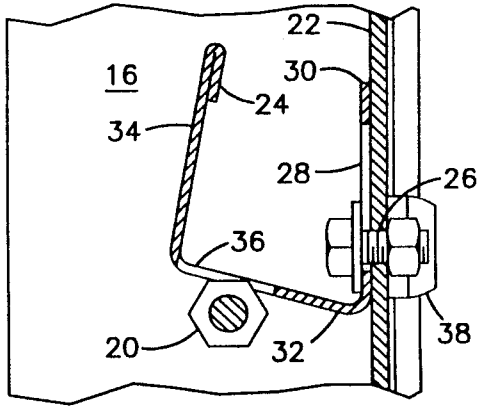
FIG. 4 is a cross-sectional side view in an unlatched position.

FIGS. 2 and 4 best show the preferred cross-sectional shape of the slide bar, which is generally U-shaped. An interior leg 30 of the slide bar is in sliding contact with the associated cover 22 and includes the slots 28. A crossbar 32 extends outwardly from the lower edge of leg 30, and in turn an outer leg 34 extends upwardly from the outer edge of the cross bar. This U-shaped configuration provides the slide bar with high strength.

As is best shown in FIGS. 2 and 4, the portion of the slide bar which passes through the longitudinal axes of the associated studs is the cross bar 32, and this portion is provided with stud slits 36 having a size and placement to allow the associated stud 20 to pass therethrough. In particular, the cross bar 3 includes the stud slits 36 extending longitudinally inward from the free ends of the slide bar. By this arrangement the slide bar 24 may be moved between a latched position of FIG. 2, where the studs are received within the periphery of the slide bar and the cover is prevented from pivoting to the open position, to an unlatched position of FIG. 4 where the stud is at least sufficiently removed from the slide bar to allow the cover to be pivoted to the open position.

In other words, in the latched position the outer leg 34 acts as a lock face against which the studs will abut, and thus prevents pivoting of the cover. During movement of the slide bar the studs pass out of the periphery of the slide bar by passing through the cross bar 32, which thus acts as a stud face of the slide bar. As may be envisioned, this latching arrangement could be achieved by other arrangements, such as a blocking member extending downward from the slide bar and movable into and out of blocking arrangements with the stud(s).

This arrangement also provides a safety feature. Specifically, when the cover is opened and the slide bar released, as by a user entering the bin, the slide bar will fall due to gravity to its latched position. As the outer leg 34 will abut against the associated stud in the latched position of the slide bar, a closing movement of the cover will cause such abutment, as may be envisioned by review of FIG. 2. As such there is no possibility of inadvertent latching of the cover while the user is inside the bin, eliminating the possibility of trapping the user therein.

Where a classic U-shaped slide bar is employed (i.e., the legs 30 and 34 being parallel), downward movement of the slide bar will be halted by abutment of the slot 28 and slide bolt 26, and the presence of the outer leg 34 will prevent full pivoting of the cover to its open position. However, due to poor tolerances, warping, etc., such an arrangement may allow a partial pivoting of the cover. This is undesirable as it may allow contamination of the bulk material within the structure.

To prevent this, it is preferred that the outer leg 34 be angled such that sliding movement toward the latched position of FIG. 2 causes the outer leg to move successively closer to the stud until the outer leg abuts with the stud, as shown in FIG. 2. This abutment will reliably prevent undesired pivoting of the cover, and the inclined arrangement will ensure such abutment even after a fair amount of dimensional variation due, for example, from thermal contraction, warpage, etc. In the preferred embodiment this inclined or angled configuration of the outer leg is simply formed by forming the outer leg such that its outer end is angled toward the interior leg 30. Other arrangements, such as separate angled or tapered members mounted on the outer leg could also be employed.

While the above arrangement is entirely suitable for a typical latching door or cover, in the particular application to grain storage bins and the like, the door area represents a weakened section of the bin, as is known in the art. To allow hoop stresses to be transmitted through the door area, there are provided at least one, and preferably several pairs of stress transfer pins 38, with the pins of each pair being located on opposite sides of the frame or cover, in the direction of hoop stresses. The pins 38 may be attached to the frame 12 in many ways, such as welding, but for simplicity it is preferred that the pins are formed by the heads of bolts secured to the frame 12 by standard nuts 40.

As is best shown in FIG. 3, the pins 38 are located within the extent or periphery of the associated cover 22 in the direction of hoop stresses, and the cover includes appropriate pin apertures 42 which receive the pins when the cover is in the closed position. The apertures 42 have a relatively close tolerance over the pins, such that deformation of the door frame due to hoop stresses (laterally across the page in FIG. 3) will cause the apertures to abut against the associated pins to thus allow the hoop stresses to be transmitted through the covers 22 and thereby prevent further deformation. As such abutment between the apertures and pins may make it difficult to pivot the cover to the open position, it is preferred that the pins be provided with rounded ends, as shown in FIG. 3.

In operation the user may manually lift the slide bar from the latched position of FIG. 2 toward the unlatched position of FIG. 4. As may be envisioned, where the angled configuration of the outer leg is employed, once the stud has left contact with the outer leg there is no further contact between these elements, allowing easier movement compared to embodiments where sliding contact between the stud and leg continues throughout movement of the slide bar. This also serves to eliminate or reduce the common problem of "freezing" of prior art latches in the closed position. This lifting of the slide bar continues until the slide bar has reached the unlatched position and pivoting of the cover 22 is possible, and the cover is then moved to the open position to allow access to the interior of the structure.

These operations are reversed for closing and latching the cover. As may be envisioned, the force of gravity may aid in downward latching movement of the slide bar, providing a simple latching arrangement. In fact, in many cases it is sufficient for the user to simply release the slide bar to effect latching. Once latched, the cover is reliably maintained in the closed position, yet may be easily and quickly opened again. As noted above, this movement of the slide bar to the latched position by gravity also serves a safety function by preventing inadvertent latching of the cover while a user is inside the storage structure.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. In a bulk material storage structure having a door frame defining an access opening for said structure, at least one pair of studs extending inward of a periphery of said frame and substantially coaxial, and at least one cover pivotally mounted to said frame for movement between open and closed positions, an improved latching arrangement, comprising:

a slide bar mounted to said cover for sliding movement over an outer face of said cover between a latched and an unlatched position, said slide bar extending between said studs when said cover is in said closed position, said slide bar including a stud portion having a slit associated with each of said studs, whereby said studs pass through said slits as said slide bar moves from between said latched and said unlatched positions, and said slide bar further including a lock portion in close opposed relation to said studs when said slide bar is in said latched position to thereby prevent substantial movement of said cover from said closed to said open position, and said lock portion being spaced from said studs when said slide bar is in said unlatched position whereby said cover may freely pivot between said open and closed position.

2. The improvement of claim 1, wherein said slide bar has a cross-section configuration of a general U-shape, with an interior leg sliding upon an outer face of said cover, a cross bar extending from a lower edge of said interior leg and including said slits therein, and an outer leg extending upward from an outer edge of said cross bar and defining said locking portion, whereby said locking portion prevents passage of said studs into or out of the interior of said U-shape while said slide bar is in said latched position.

3. The improvement of claim 2, wherein said outer leg angles toward said interior leg in a direction towards a free end of said outer leg, and wherein movement of said slide bar from the unlatched to the latched position is in a second direction generally opposite to said direction towards a free end of said outer leg.

4. The improvement of claim 3, wherein said second direction is substantially vertical, whereby said slide bar moves from said unlatched to said latched position under the force of gravity.

5. The improvement of claim 1, wherein said frame includes at least one pair of stress transfer pins extending inwardly of said structure, and located within the periphery of said cover, and wherein said cover includes mating apertures therein, wherein said pins are received within said apertures when said cover is in said closed position.

6. In a bulk material storage structure having a door frame defining an access opening for said structure, at least one pair of studs extending inward of a periphery of said frame and being substantially coaxial, and at least one cover pivotally mounted to said frame for movement between open and closed positions, an improved latching arrangement, comprising:

a slide bar mounted to said cover for sliding movement along an outer face of said cover between latched an unlatched positions, said slide bar including a lock portion in at least close proximity to said stud, with said stud interposed between said lock portion and said frame, when said slide bar is in said latched position, and said lock portion being spaced from said stud along a pivot axis of said cover when said slide bar is in said unlatched position.

7. The improvement of claim 6, wherein said lock portion is in abutment with said stud when said slide bar is in said latched position.

8. The improvement of claim 6, wherein said movement of said slide bar between said latched and said unlatched position is substantially vertical.

9. The improvement of claim 6, wherein said frame includes at least one pair of stress transfer pins extending inwardly of said structure, and located within the periphery of said cover, and wherein said cover includes mating apertures therein, wherein said pins are received within said apertures when said cove is in said closed position.

* * * * *